US010501238B2

(12) United States Patent
Ke

(10) Patent No.: US 10,501,238 B2
(45) Date of Patent: Dec. 10, 2019

(54) LID MODULE FOR A CUP

(71) Applicant: Seikilife (Shanghai) Housewares Co., Ltd., Shanghai (CN)

(72) Inventor: David Ke, Shanghai (CN)

(73) Assignee: Seikilife (Shanghai) Housewares Co., Ltd., Shanghai (CN)

( * ) Notice: Subject to any disclaimer, the term of this patent is extended or adjusted under 35 U.S.C. 154(b) by 227 days.

(21) Appl. No.: 15/702,231

(22) Filed: Sep. 12, 2017

(65) Prior Publication Data

US 2019/0002168 A1 Jan. 3, 2019

(30) Foreign Application Priority Data

Jun. 28, 2017 (CN) ..... 2017 1 0504536

(51) Int. Cl.
*A47G 19/22* (2006.01)
*B65D 43/02* (2006.01)

(52) U.S. Cl.
CPC ..... *B65D 43/022* (2013.01); *A47G 19/2272* (2013.01)

(58) Field of Classification Search
CPC ..... B65D 43/022; B65D 2543/00046; A47G 19/2272
USPC ..... 215/279; 220/254.1, 254.3, 254.8, 255, 220/256.1, 713
See application file for complete search history.

(56) References Cited

U.S. PATENT DOCUMENTS 4,238,045 A * 12/1980 D'Andria ..... A47G 19/2272 220/254.5
5,680,951 A * 10/1997 Feltman, III ..... A47G 19/2272 220/253
5,961,004 A * 10/1999 DeMars ..... A47G 19/2288 220/710.5
6,102,244 A * 8/2000 Kuwano ..... A47G 19/2272 220/711

* cited by examiner

*Primary Examiner* — Andrew T Kirsch
*Assistant Examiner* — Elizabeth J Volz
(74) *Attorney, Agent, or Firm* — Wang Law Firm, Inc.

(57) ABSTRACT

A lid module adapted to cover a top opening of a cup body includes a plug device movably and expandably received inside the inner ring to adapt to a cup body so that the lid module has a water tight engagement with the inner periphery of the cup body when the plug device is in an expanded status and the lid module is freely movable relative to the cup body when the plug device is in a contracted status. A lid has an outer ring, an inner ring integrally formed with the outer ring and a hollow central ring integrally formed with the inner ring and having an inner diameter larger than that of an outer diameter of the tube so that the tube is able to extend into the hollow central ring and be securely received therein and a securing mechanism integrally formed with the inner ring.

10 Claims, 13 Drawing Sheets

LID MODULE FOR A CUP

CROSS REFERENCE TO RELATED APPLICATION

This application claims the benefit of priority to CN 201710504536.0, filed on Jun. 28, 2017 with the State Intellectual Property Office of the People's Republic of China, the entirety of which is incorporated by reference herein.

TECHNICAL FIELD

The preferred embodiment of the present invention is related to the field of a lid and, more particularly, to a lid module having a mechanism to adjust its abutment to the internal wall of a cup.

BACKGROUND OF THE INVENTION

Nowadays, people are paying more attention to daily water consumption and because of that, various containers are commercially available in the market to individually emphasize its multi-functionalities. Among these containers, most of the lids used to cover the cups are provided with either outer threading or internal threading to mate with the internal threading or outer threading formed on the cup body, such that when the outer/internal threading of the lid is threadingly connected to the internal/outer threading of the cup body, water inside the container kept inside the cup body in a water-tight manner. After removing the lid from the cup body, the user is then able to drink the water directly from the cup body. However, due to the formation of either the internal threading or outer threading on either the lid or the cup body, the user will experience an odd feeling as the user's lip is placing directly on top of either the internal or outer threading on the cup body when drinking the water. Furthermore, the formation of threading on the lid and the cup body makes cleaning of the lid and the cup body difficult as germs is easily using spaces between two adjacent threading to grow. Also, dust and other contaminant may accumulate in the same spaces.

In order to obviate or mitigate the aforementioned problems, Chinese patent application No. ZL201020102745.6 and ZL201010172687.9 discuss a threading-free lid module to solve the cleaning problem. For example, with reference to FIG. 1, as shown in Chinese patent application No. ZL201020102745.6, a cup module is disclosed, wherein the cup module has a lid 1, a sealing ring 2, a cup body 3, an outer threading 4, a handle fixture 5, a handle 6, a hexagonal screw 7 and a positioning plate 8. The positioning plate 8 is connected to the outer threading 4 and inserted into the handle fixture 5. Thus, the seal to the cup body 3 by the lid 1 is completed by the combination between the outer threading 4 and the inner threading formed on an inner face of the lid 1 with the assistance of the sealing ring 2 sandwiched between the lid 1 and the cup body 3. From the depiction of FIG. 1, it is learned that the operation is entirely controlled by the handle 6. However, the handle 6 which stands out from the cup body 3 is easily damaged or deformed by environment and causes inferior safety and sealing effect between the lid 1 and the cup body 3.

As shown in FIG. 2, a conventional cup module having a cap and a body is disclosed in Chinese patent application ZL201010172687.9, which includes a body 1, a cap 2 composed of an upper cap 5 and a lower cap 6 rotatable relative to the upper cap 5, a seal face 3 sandwiched between the body 1 and the cap 2, an annular recess 4 defined in an upper inner face of the body 1, a connector 7 sandwiched between the upper cap 5 and the lower cap 6, a sliding block 9 slidably received in a sliding track inside the lower cap 6, an annular ridge 10 formed on the sliding block 9 to correspond to the annular recess 4, a recoil spring 11 one distal end of which is securely connected to the sliding block 9 and the other distal end of which is securely connected to a stop 12 formed inside the lower cap 6 and a push 13 provided inside the upper cap 5 and having a driving face 14 engaged with the sliding block 9 to force the sliding block 9 to move inside the lower cap 6. Even though, there is no threading formed either in the cap 2 or the body 1 to complete the seal combination between the cap body 1 and the cap 2, there is still a recess formed inside the upper inner face of the body 1, which is deemed as the conventional threading. Still since the formation of the annular recess 4 inside the body 1, germs and/or contaminants are/is easily using the space inside the recess as a habitat and thus causes a serious hygienic problem.

SUMMARY OF THE INVENTION

It is an objective of the preferred embodiment of the present invention to provide a threading-free lid module having a seal selectively expandably engaged with an inner face of a cup body to accomplish the purpose of sealing the cup body without the need of threading.

One objective of the preferred embodiment of the present invention is to provide a lid module adapted to cover a top opening of a cup body, the lid module having a lid having an outer ring, an inner ring integrally formed with the outer ring and a securing mechanism integrally formed with the inner ring; and a plug device movably and expandably receive inside the inner ring to adapt to an inner periphery of a cup body so that the lid module is able to have a water tight engagement with the inner periphery of the cup body when the plug device is in an expanded status and the lid module is freely movable relative to the cup body when the plug device is in a contracted status.

A different objective of the preferred embodiment of the present invention is that the plug device includes a plug with a tube and spaced leaves integrally extending out from a bottom of the tube and selectively expandable relative to the tube so that the plug is able to selectively have a water tight engagement with the inner periphery of the cup body.

A different objective of the preferred embodiment of the present invention is that the lid further has a hollow central ring integrally formed with the inner ring and having an inner diameter larger than that of an outer diameter of the tube so that the tube is able to extend into the hollow central ring and be securely received therein.

A different objective of the preferred embodiment of the present invention is that the inner ring has a first fixing device formed on an inner periphery thereof and the plug has a second fixing device formed on an outer periphery thereof to correspond to the first fixing device such that the plug is securely yet movably received inside the inner tube after the first fixing device is connected to the second fixing device.

A different objective of the preferred embodiment of the present invention is that a seal is mounted around an outer periphery of the leaves so that when the leaves are expanded, the seal is expanded to adapt to the inner periphery of the cup body and the plug together with the seal is able to selectively have a water tight engagement with the inner periphery of the cup body.

A different objective of the preferred embodiment of the present invention is that each of the leaves has a rib formed on a side face of each of the leaves, the inner tube has a tapered bottom end face corresponding to the rib such that when the plug is movable relative to the inner tube, engagement between the tapered bottom end face and the ribs forces the leaves to expand outward relative to the tube.

A different objective of the preferred embodiment of the present invention is that a stop is removable yet partially and securely received inside the central tube, the stop having a stopping shoulder formed on an outer periphery thereof to abut against a bottom most end of the stop to prevent the plug from escaping from the lid.

A different objective of the preferred embodiment of the present invention is that a central column has a top portion provided with a first threading formed on an outer periphery thereof to correspond to a first fixing device formed on an inner periphery of the tube and a bottom portion integrally formed with the top portion and having a diameter smaller than that of the top portion, the bottom portion having a second threading formed on an outer periphery thereof, A different objective of the preferred embodiment of the present invention is that a stop is removably received inside the inner ring and has a second fixing device formed on an inner periphery thereof to correspond to the second threading of the central column so that when the second fixing device is connected to the second threading, the stop is securely received inside the inner ring.

A different objective of the preferred embodiment of the present invention is that the lid further has a central column having a top portion provided with a first threading formed on an outer periphery thereof to correspond to a first fixing device formed on an inner periphery of the tube and a bottom portion integrally formed with the top portion and having a diameter smaller than that of the top portion, the bottom portion having a second threading formed on an outer periphery thereof, a stop removably received inside the inner ring and having a second fixing device formed on an inner periphery thereof to correspond to the second threading of the central column so that when the second fixing device is connected to the second threading, the stop is securely received inside the inner ring.

Furthermore, another objective of the preferred embodiment of the present invention is that there is provided with second water seals to inlets of the first outlet and the second outlet.

DETAILED DESCRIPTION OF THE PREFERRED EMBODIMENT

Figure 1:
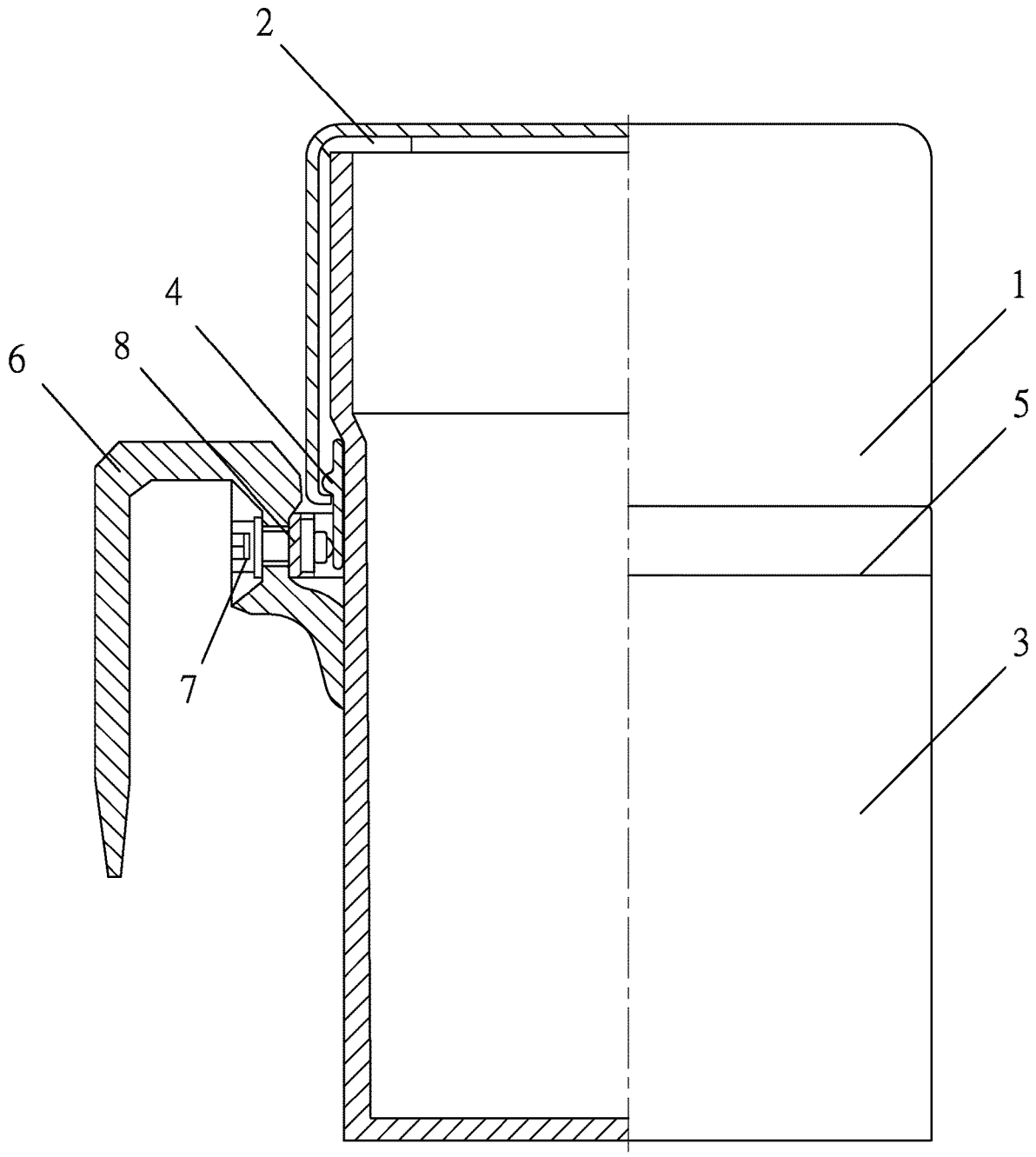
Fig.1 Prior Art
FIG. 1 is schematic partially cross-sectioned view of a conventional cup assembly.
Figure 2:
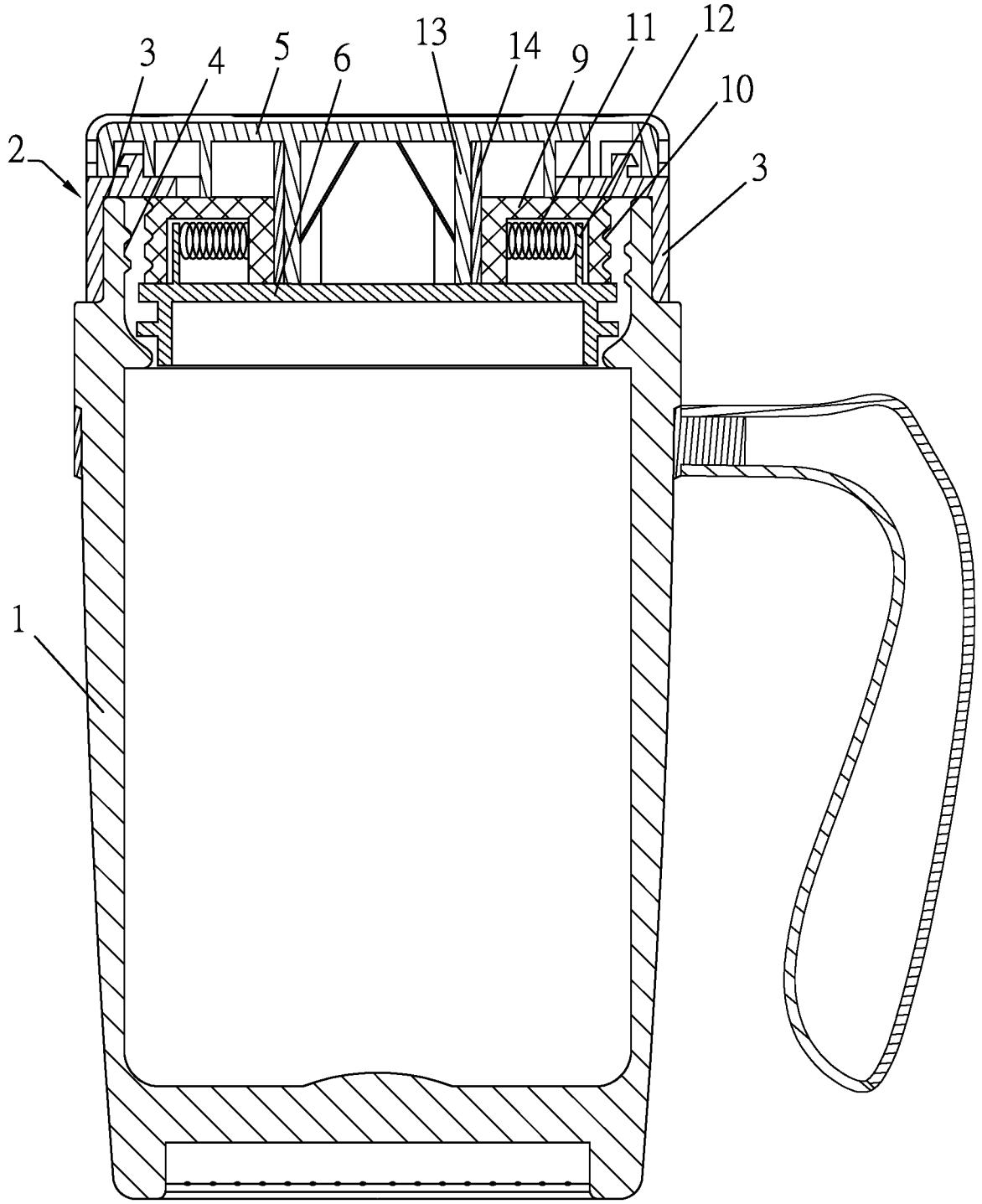
Fig.2 Prior Art
FIG. 2 is a cross sectional view of a conventional cup assembly.

Preferred embodiment(s) of the present invention in combination with the attached drawings shall be provided in detail in the following description. However, the given description is for example purpose only and should not be deemed as a limiting to the scope of the present invention in any way.

In order to make it easy to carry out the preferred embodiment of the present invention, a detailed description of the parts of the invention, supported with figures is provided here. As each part of the preferred embodiment of the present invention has many features, it is made easy to read, by referring to each feature with a number included in the parts description text. The number of the parts feature(s) is indicated here by starting it sequentially from the number 11, wherever a part feature appears in a text, an associated serial number is directly assigned.

With reference to FIGS. 3, 4, 5, 6 and 7, the lid module constructed in accordance with the preferred embodiment of the present invention includes a lid 11, a plug 12 movably received inside the lid 11, a seal 13 securely mounted around an outer periphery of the plug 12 and a stop 16 securely and firmly received in the lid 11 to selectively engage with a bottom face of the plug 12 to support and stop the plug 12 from escaping the lid 11.

The lid 11 is composed of an outer ring 111, an inner ring 112 integrally formed inside the outer ring 111 and having a first fixing device 114 formed in an inner face of the inner ring 112 and a central ring 113 centrally formed inside the inner ring 112. The first fixing device 114 may be a series of threading, an annular recess or the like formed inside the inner ring 112.

The plug 12 is movably received inside the lid 11 and has a centrally formed tube 121 extending upward from a bottom of the plug 12, a centrally defined through hole 121 defined in the tube 121 and provided with a diameter slightly larger than that of an outer diameter of the central ring 113 so that the central ring 113 is able to extend into the through hole 122, a second fixing device 123 formed on an outer periphery of the tube 121 to correspond to the first fixing device 114 of the inner ring 112, a plurality of equally spaced leaves 14 integrally standing upward from the bottom of the plug 12 and each having a rib 15 formed on a side face thereof and an annular boss 141 formed on the other side thereof and a pair of cutout 160 defined in an inner periphery defining the through hole 122 of the tube 121. The second fixing device 123 may be a threading, an annular boss or the like so as to correspond to the first fixing device 114 of the inner ring 112.

The seal 13 is preferably made of silicon and used to securely surround an outer face of each of the leaves 14. Preferably, an outer periphery of the seal 13 is provided with continuous annular faces.

The stop 16 is composed of a first wing 161, a second wing 162 spaced apart from the first wing 161 and a head 163 integrally formed with the first wing 161 and the second wing 162 and provided with a shoulder 1631 formed on an outer periphery of the head 163 to correspond to a step 1131 formed on an inner periphery of the central ring 113.

Figure 3:
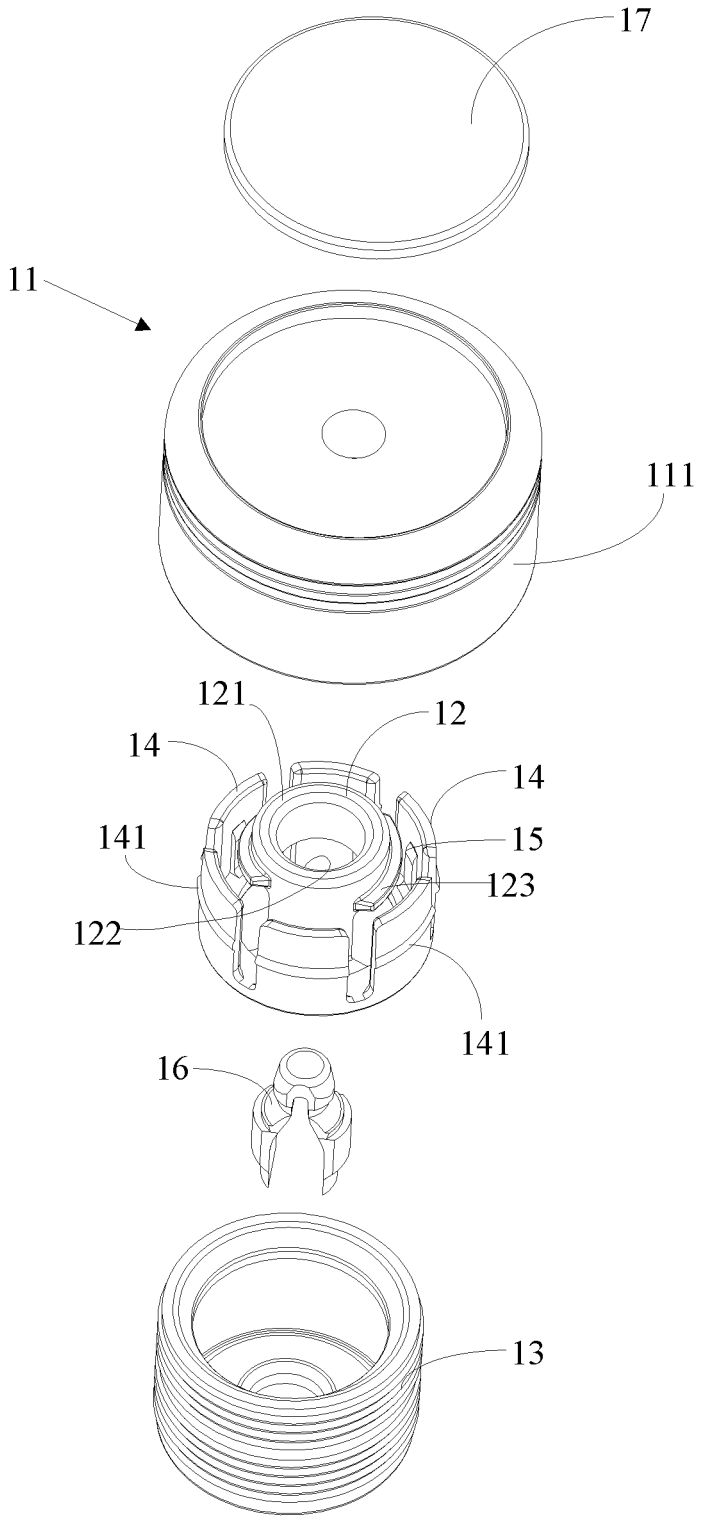
FIG. 3 is an exploded perspective view of the lid module of the preferred embodiment of the present invention.
Figure 4:
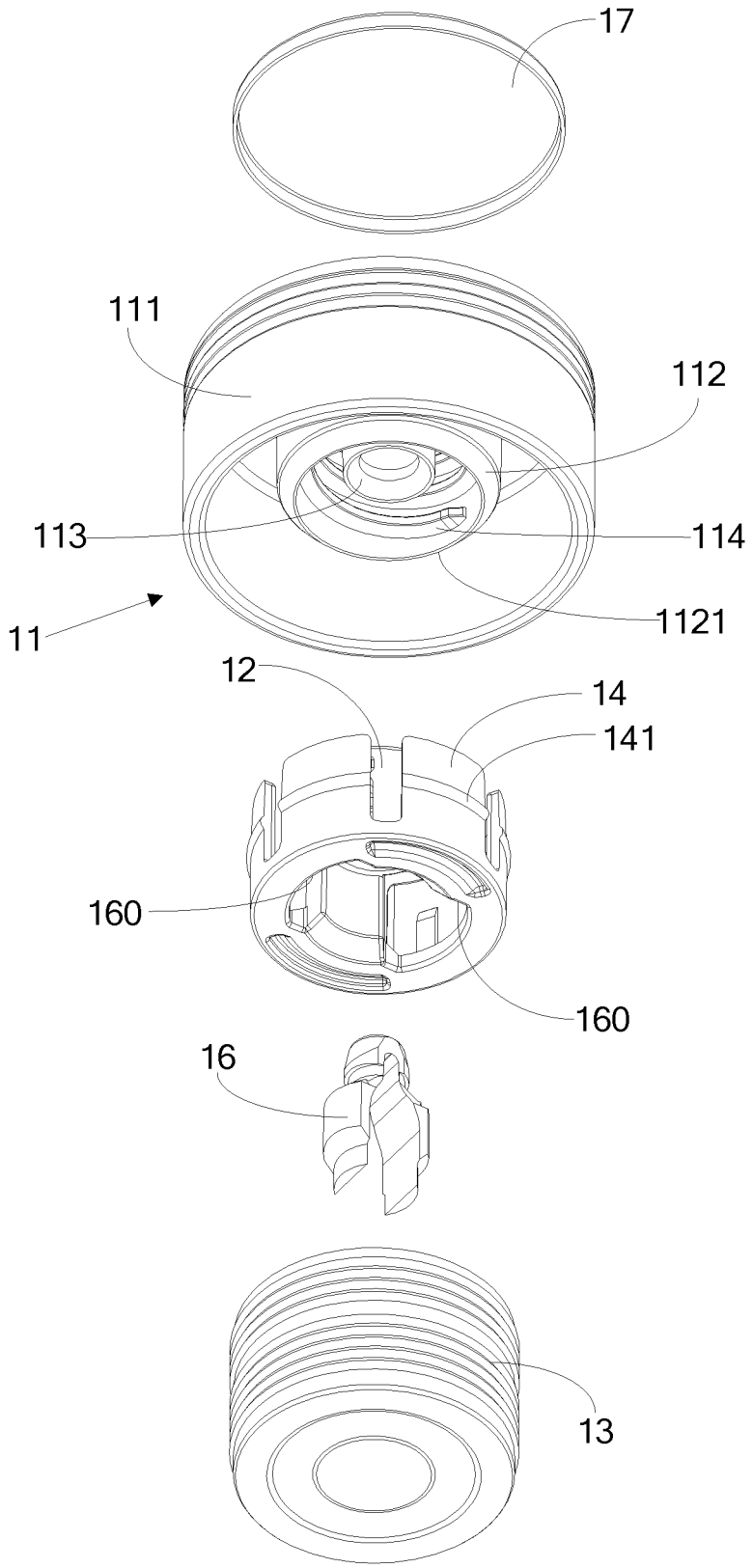
FIG. 4 is an exploded perspective view of the lid module shown in FIG. 1 from a different angle.
Figure 5:
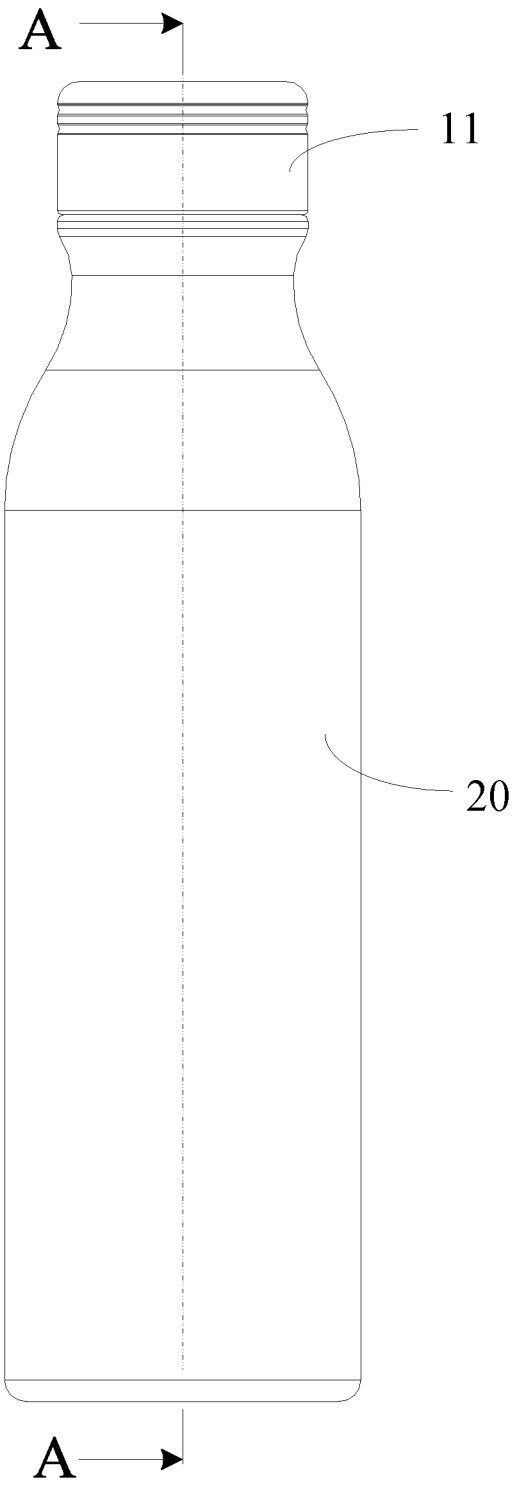
FIG. 5 is a plan view showing the application of the lid module of the preferred embodiment of the present invention with a cup body.
Figure 6:
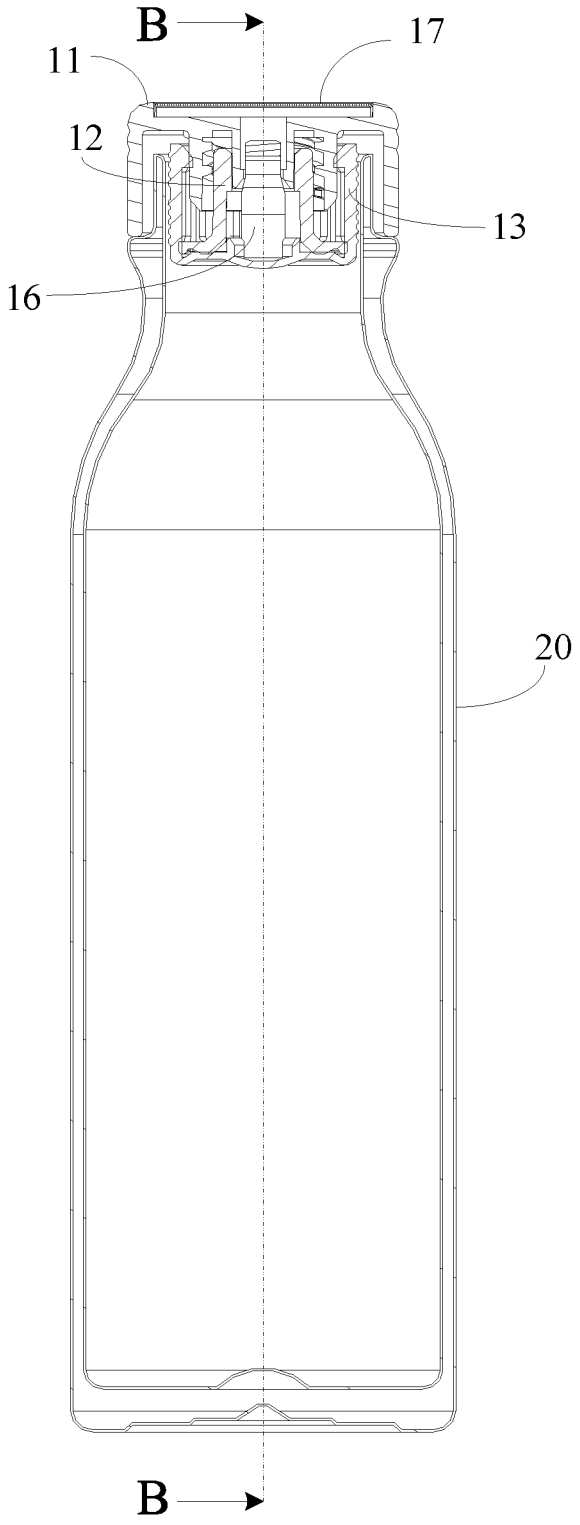
FIG. 6 is a cross sectional view taken from line A-A in FIG. 5.
Figure 7:
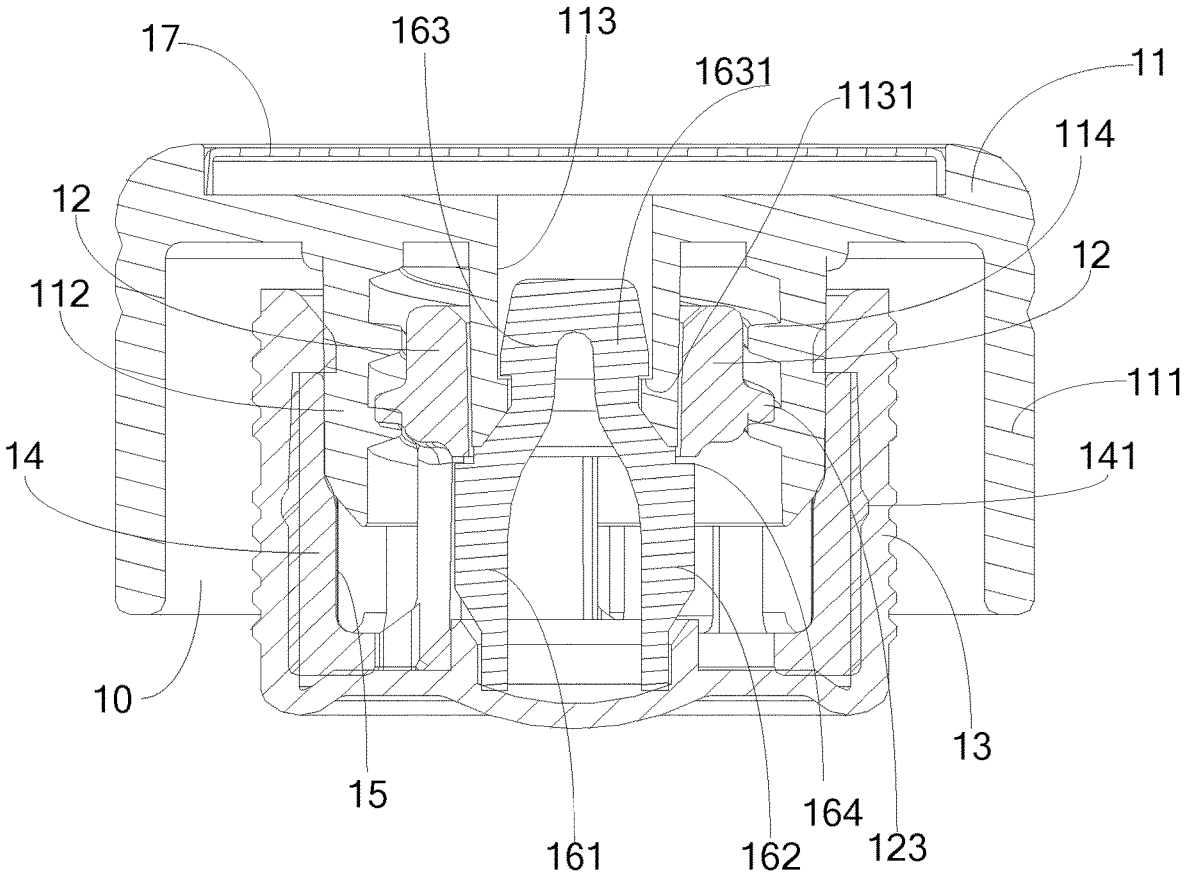
FIG. 7 is a cross sectional view taken from line B-B in FIG. 6.

With reference especially to FIGS. 3, 4 and 7, it is noted that when the lid module of the preferred embodiment of the present invention is to be assembled, due to the elasticity of the material for the stop 16, the first wing 161 and the second wing 162 are forced to move closer to each other to allow the first wing 161 and the second wing 162 to be received inside the through hole 122 of the plug 12 and the head 163 of the stop 16 to extend into the central tube 113 to allow the shoulder 1631 to be rested on the step 1131. Thus, after the shoulder 1631 rests on the step 1131, the stop 16 is firmly connected to the central ring 113 of the lid 11. As described, before the stop 16 is connected to the lid 11, the plug 12 with the seal 13 securely provided around the outer periphery of the leaves 14 is extended to the lid 11 to allow the central ring 113 to be received in the through hole 122 while the first fixing device 114 is connected to the inner ring 112. In this preferred embodiment, it is learned from FIG. 7 that the first fixing device 114 and the second fixing device 123 are both threadings respectively formed on the inner periphery of the inner ring 112 of the lid 11 and the outer periphery of the tube 121 of the plug 12. After the first fixing device 114 and the second fixing device 123 are securely connected to one another, a bottom face of the plug 12 is abutted against a stopping shoulder 164 formed on an outer periphery of the stop 16. Thus the plug 12 with the bottom face abutted against the stopping shoulder 164 is prevented front escaping the lid 11. Furthermore, a receiving space 10 is defined between an outer periphery of the seal 13 and an inner periphery of the outer ring 111 such that when the lid module of the preferred embodiment of the present invention is used with a cup body (not shown), the open end of the cup body is able to extend into the receiving space. It is further noted that the inner ring 112 has a tapered bottom end face 1121 formed on a bottom free end of the inner ring 112 to correspond to the ribs 15 of the leaves 14.

While the lid module of the preferred embodiment of the present invention is in application with, for example, a cup body, the open end of the cup body is first extended into the receiving space 10 to an appropriate depth depending on various design choices. After the open end of the cup body is extended into the receiving space 10, the outer periphery of the seal 13 is able to securely engage with an outer periphery of the cup body because of an appropriate thickness choice as well as roughness design of the seal 13. Again, due to the elasticity of the material for the seal 13, the seal 13 is securely engaged with the inner periphery of the cup body and thus the plug 12 as well as the leaves 14 is rigid relative to the cup body. However, the lid 11 is still rotatable or movable relative to the plug 12. That is, the first fixing device (threading) 114 is threadingly connected to the second fixing device 123 (threading), which allows the lid 11 to be rotatable relative to the plug 12. Therefore, rotation of the lid 11 makes the plug 12 to move inside the inner ring 112. Clockwise/counterclockwise rotation of the lid 11 allows the plug 12 to move upward/downward and while the plug 12 is moving downward, the tapered bottom end face 1121 gradually engages with the ribs 15 of the leaves 14. While the plug 12 continuously moves downward relative to the lid 11, the tapered bottom end face 1121 forces the leaves 14 to extend outward (deform), which expands a diameter of the seal 13 to further enhance the engagement with the open end of the cup body. While the seal 13 is forced to expand to strengthen the engagement with the inner periphery of the cup body, a water-tight or air-tight engagement between the lid module and the cup body is achieved without the need of forming threading on the cup body or the inner periphery of the outer ring. Therefore, defining an open in the lid 11 to communicate with an interior of the central ring 113 allows the user to drink water contained inside the cup body. A cover 17 is thus provided to selectively connect to a top face of the lid 11 to close the open of the lid 11 to maintain the water contained inside the cup body clean. When the lid module of this preferred embodiment is to be removed for repair/replacement or clean, the user rotates the outer ring 111 in a direction to allow the plug 12 to move inside the inner ring 112 toward the cover 17. As the plug 12 is moving upward toward the cover 17, the tapered bottom end face 1121 gradually leaves the engagement with the ribs 15, which allows the leaves 14 to return to their original position and that reduces the diameter of the seal 13. After the seal 13 returns to its original dimension, the cup body is then able to remove from the lid module of this preferred embodiment of the present invention.

However, in a different preferred embodiment of the present invention, the stop is optional if the first fixing device 114 of the inner ring 112 is designed in a manner that the once the plug 12 is rotated to a bottom most threading, the plug 12 cannot rotate anymore.

Figure 8:
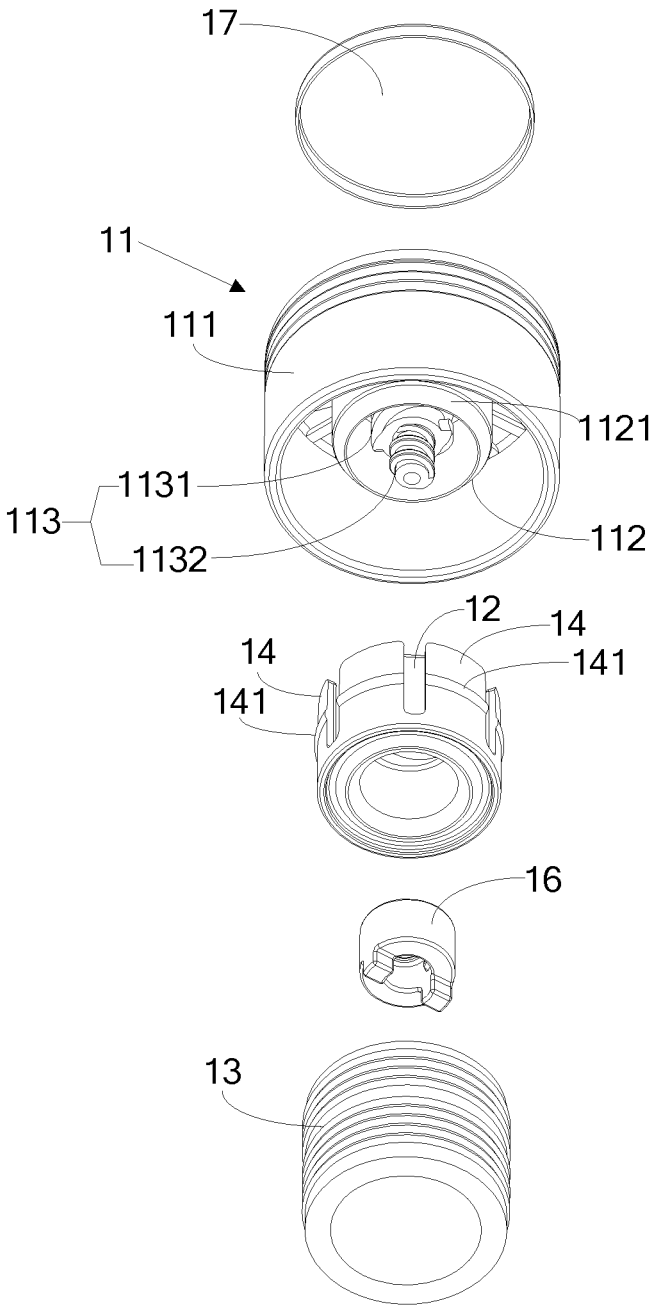
FIG. 8 is an exploded perspective view showing the second embodiment of the preferred embodiment of the present invention.
Figure 9:
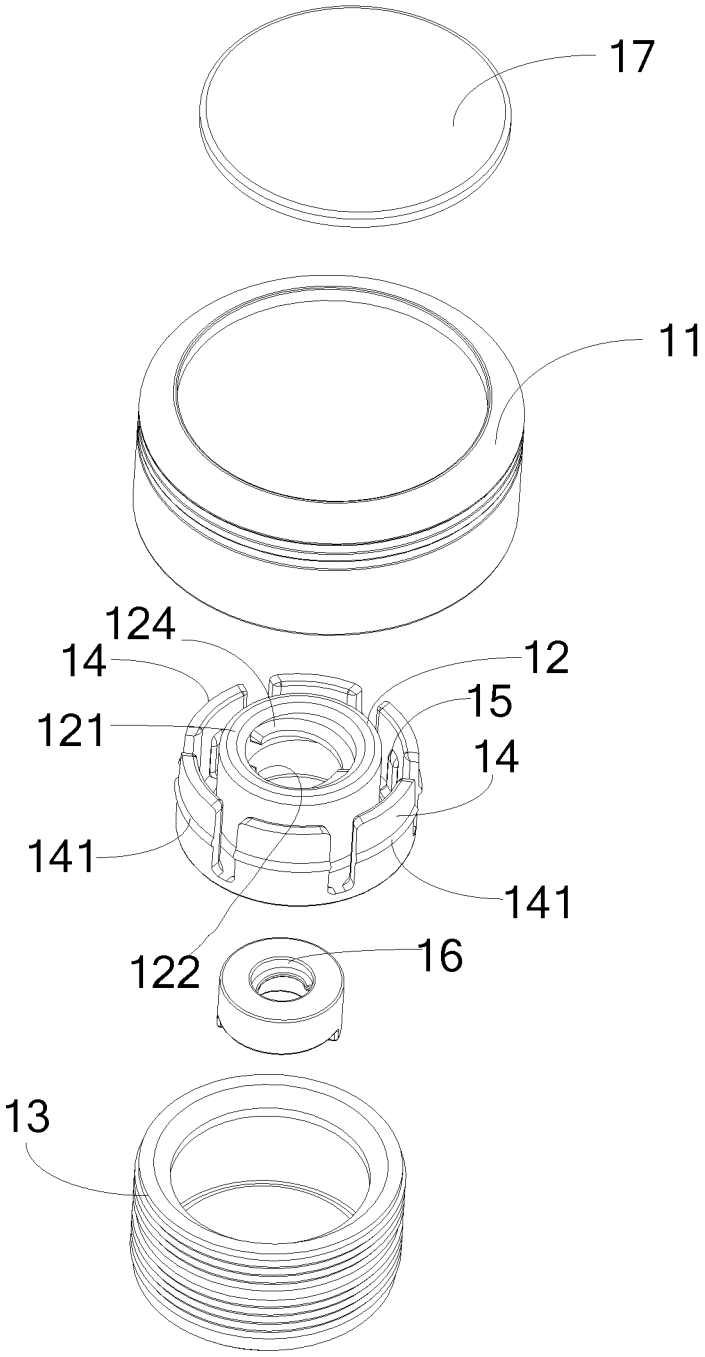
FIG. 9 is still an exploded perspective view of the lid module of the preferred embodiment of the present invention shown in FIG. 8 from a different angle.

With reference to FIGS. 8 and 9, a second preferred embodiment of the lid module constructed in accordance with the present invention is shown and disclosed. The lid module as shown is provided with substantially the same elements as those in the first preferred embodiment. To those similar or substantially the same elements shown in the first preferred embodiment, there will be no detailed description to describe the shape, the structure and the functionality of the same for brevity. As such, the following description is focus on the differences between the first preferred embodiment and the second preferred embodiment.

The lid module constructed in accordance with the second preferred embodiment of the present invention has a lid 11, a plug 12 selectively movable inside the lid 11, a seal 13 firmly mounted around the plug 12 and selectively expandable for engagement with a cup body and a stop 16 securely connected to the lid to support the plug 12 from escaping the lid 11.

The lid 11 is composed of an outer ring 111, an inner ring 112 integrally formed inside the outer ring 111 and having a tapered bottom end face 1121 and a central column 113 centrally formed inside the inner ring 112. It is to be noted that the central column 113 has a top portion and a bottom portion integrally formed with the top portion. The top portion has a diameter larger than that of the bottom portion and the top portion has a first threading 1131' formed on an outer periphery thereof and the bottom portion has a second threading 1132 formed on an outer periphery thereof.

The plug 12 is movably received inside the lid 11 and has a centrally formed tube 121 extending upward from a bottom of the plug 12, a centrally defined through hole 122 defined in the tube 121 and provided with a diameter slightly larger than that of an outer diameter of the central column 113 so that the central column 113 is able to extend into the through hole 122, a third threading 124 formed on an inner periphery defining the through hole 122 to correspond to the first threading 1131' of the central column 113, a plurality of equally spaced leaves 14 integrally standing upward from the bottom of the plug 12 and each having a rib 15 formed on a side face thereof and an annular boss 141 formed on the other side thereof.

The seal 13 is, preferably, made of elastomer so that the seal 16 has an appropriate elasticity to accomplish the designed task. Preferably, an outer periphery of the seal has a series of roughness formed thereon.

The stop 16 is hollow and has two open ends to receive therein the bottom portion of the central column 113 of the lid 11. A fourth threading 164 is formed on an inner periphery of the seal 16 to correspond to the second threading 1132.

Figure 10:
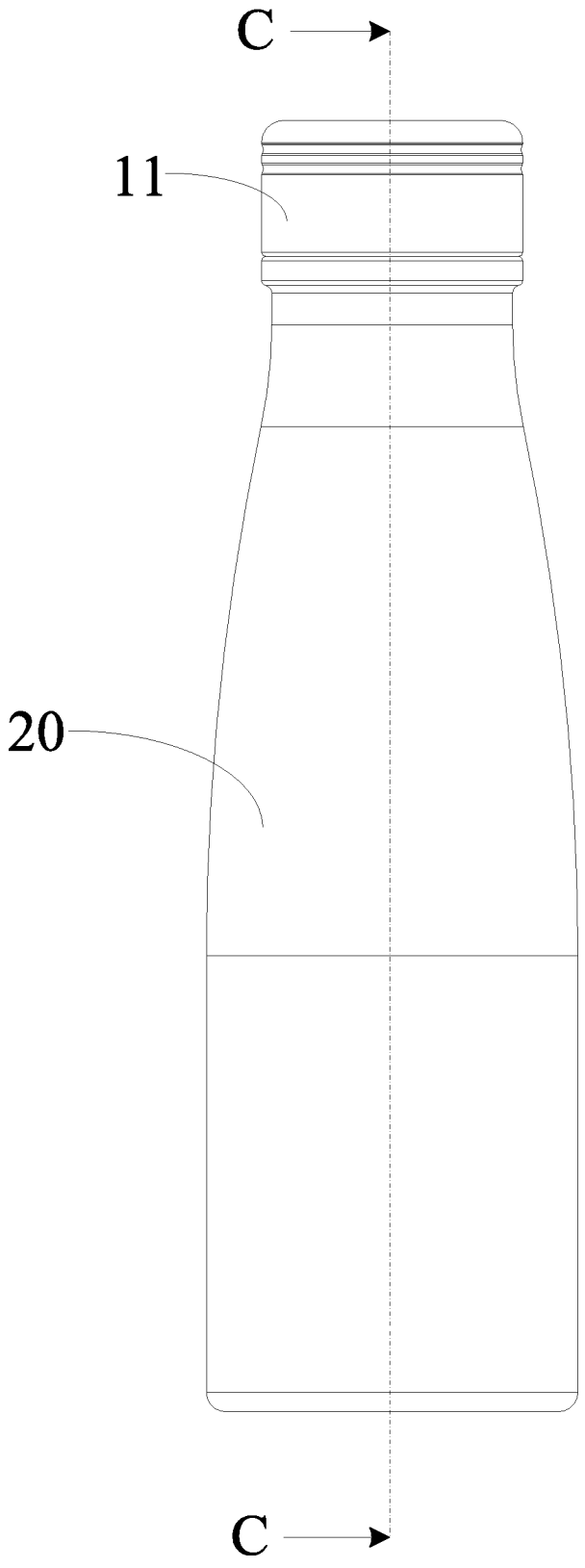
FIG. 10 is a plan view showing the application of the lid module shown in FIG. 8.
Figure 11:
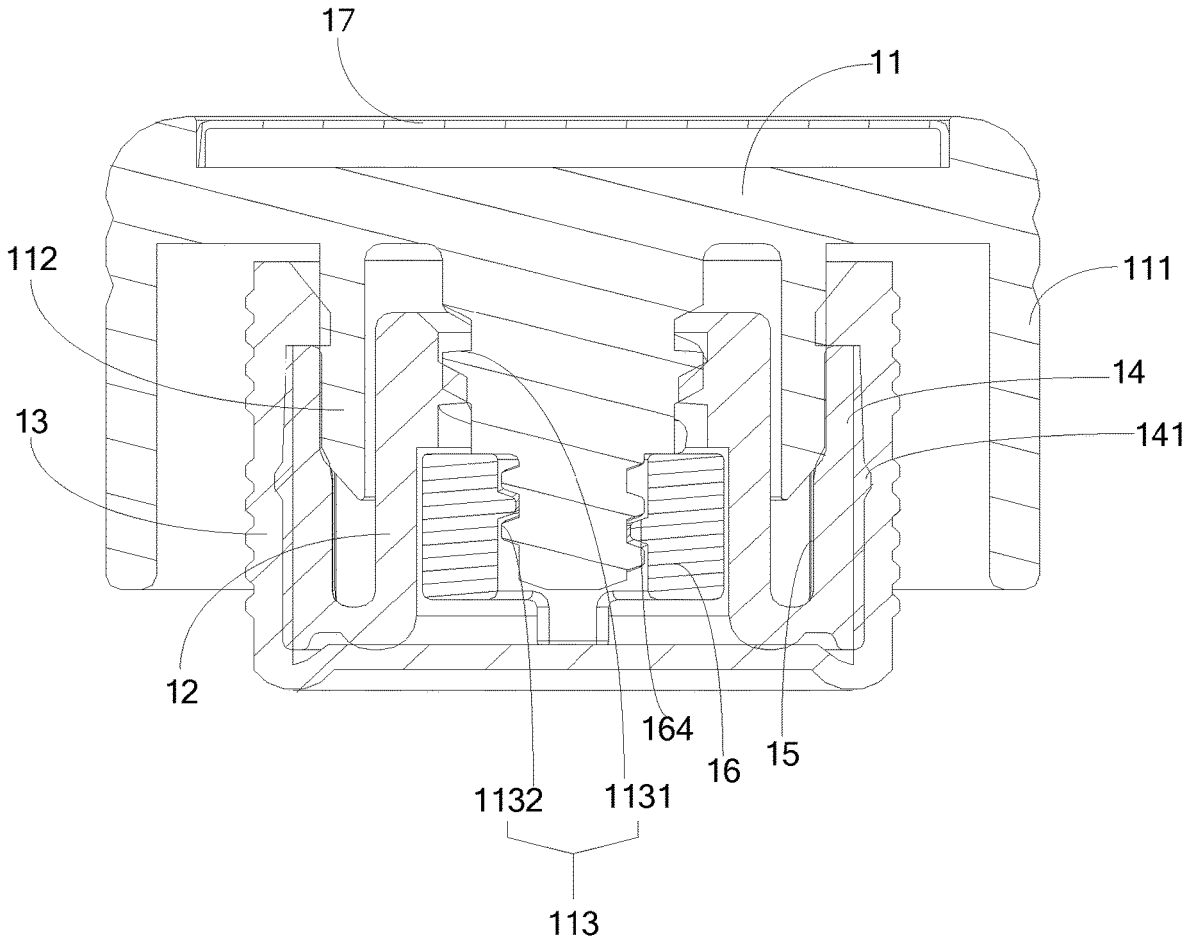
FIG. 11 is a cross sectional view taken from line C-C in FIG. 10.

With reference to FIGS. 10 and 11, when the lid module of the second preferred embodiment is to be assembled for use, central column 113 is extended into the through hole 122 of the plug 12 to allow the first threading 1131' to threadingly connect to the third threading 124 of the plug 12 while the seal 13 is securely and firmly mounted around the plug 12, i.e., an outer periphery of the leaves 14. After which, bottom portion of the central column 113 is extended into the hollow stop 16 to have the second threading 1132 to threadingly connect to the fourth threading 164 while a top face of the stop 16 is abutted against a periphery defining a bottom most tooth of the third threading 124 to prevent the plug 12 from escaping the lid 11. It is noted that a receiving space 10 is thus defined between an outer periphery of the seal 13 and an inner periphery of the outer ring 111.

While the lid module of the second preferred embodiment of the present invention is in application with, for example, a cup body, the open end of the cup body is first extended into the receiving space 10 to an appropriate depth depending on various design choices. After the open end of the cup body is extended into the receiving space 10, the outer periphery of the seal 13 is able to securely engage with an outer periphery of the cup body because of an appropriate thickness and roughness design choice of the seal 13. Again, due to the elasticity of the material for the seal 13, the seal 13 is securely engaged with the inner periphery of the cup body and thus the plug 12 as well as the leaves 14 is rigid relative to the cup body. However, the lid 11 is still rotatable or movable relative to the plug 12. That is, the first threading 1131' is threadingly connected to the third threading 124, which allows the lid 11 to be rotatable relative to the plug 12. Therefore, rotation of the lid 11 makes the plug 12 to move inside the inner ring 112. Clockwise/counterclockwise rotation of the lid 11 allows the plug 12 to move upward/downward and while the plug 12 is moving downward, the tapered bottom end face 1121 gradually engages with the ribs 15 of the leaves 14. While the plug 12 continuously moves downward relative to the lid 11, the tapered bottom end face 1121 engaging with the ribs 15 forces the leaves 14 to extend outward (deform), which expands a diameter of the seal 13 to further enhance the engagement with the inner periphery of the cup body. While the seal 13 is forced to expand to strengthen the engagement with the inner periphery of the cup body, a water-tight or air-tight engagement between the lid module and the cup body is achieved without the need of forming threading on the cup body or the inner periphery of the outer ring. Therefore, defining an opening in the lid 11 to communicate with an interior of the central column 113 allows the user to drink water contained inside the cup body. A cover 17 is thus provided to selectively connected to a top face of the lid 11 to close the opening of the lid 11 to maintain the water contained inside the cup body clean. When the lid module of this preferred embodiment is to be removed for repair/replacement or clean, the user rotates the outer ring 111 in a direction to allow the plug 12 to move inside the inner ring 112 toward the cover 17. As the plug 12 is moving upward toward the cover 17, the tapered bottom end face 1121 gradually leaves the engagement with the ribs 15, which allows the leaves 14 to return to their original position and that reduces the diameter of the seal 13. After the seal 13 returns to its original dimension, the cup body is then able to remove from the lid module of this preferred embodiment of the present invention.

Figure 12:
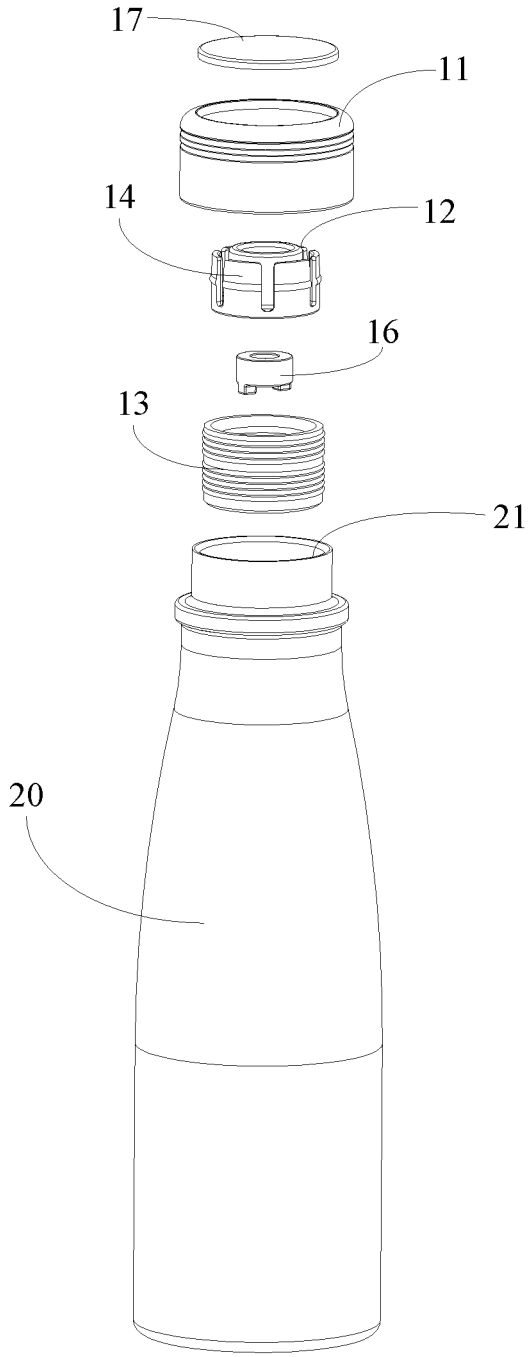
FIG. 12 is an exploded perspective view of the lid module of the third preferred embodiment of the present invention used with a cup body.
Figure 13:
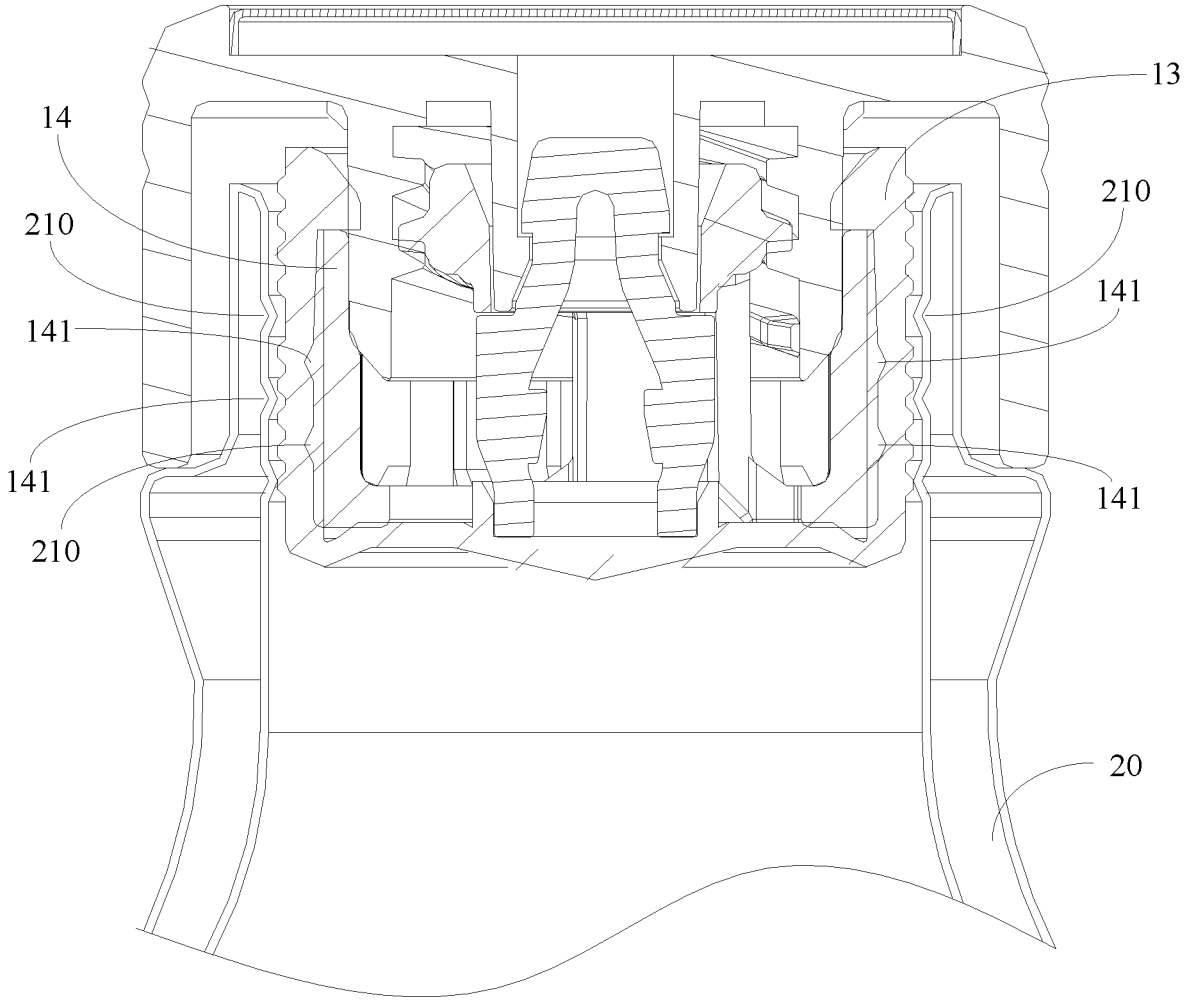
FIG. 13 is a cross sectional view showing the third preferred embodiment of the present invention.

With reference to FIGS. 12 and 13, in this embodiment, most of the elements are substantially the same as those in the second embodiment, the only difference is that the cup body 20 may be provided with a single threading 210 defined in an open end 21 of the cup body 20 so that when the open end 21 of the cup body 20 is extended into the receiving space (not numbered), the annular boss 141 formed on an outer periphery of each of the leaves 14 and engaging with the single threading 210 of the cup body 20 increases friction therebetween.

After a detailed description of the preferred embodiment(s) has been provided, any skilled person in the art would easily understand the description so provided is for example purpose only. The scope for protection of the present invention is defined by the attached claims. Any skilled person in the art would easily amend, modify or alter the elements/devices of the present invention without departing from the principle essence and spirit of the present invention. However, the amendment, modification or alteration shall fall within the protection scope sought of the present invention.

What is claimed is:

1. A lid module adapted to cover a top opening of a cup body, the lid module comprising:

a plug device movably and expandably received inside an inner ring to adapt to an inner periphery of a cup body, wherein the plug device includes a plug with a tube and spaced leaves integrally extending out from a bottom of the tube and selectively expandable relative to the tube so that the lid module is able to have a water tight engagement with the inner periphery of the cup body when the plug device is in an expanded status and the lid module is freely movable relative to the cup body when the plug device is in a contracted status a lid having an outer ring, the inner ring integrally formed with the outer ring, and a hollow central ring integrally formed with the inner ring and having an inner diameter larger than that of an outer diameter of the tube so that the tube is able to extend into the hollow central ring and be securely received therein and a securing mechanism integrally formed with the inner ring.

2. The lid module as claimed in claim 1, wherein the inner ring has a first fixing device formed on an inner periphery thereof and the plug has a second fixing device formed on an outer periphery thereof to correspond to the first fixing device such that the plug is securely yet movably received inside the inner tube after the first fixing device is connected to the second fixing device.

3. The lid module as claimed in claim 2 further comprising a stop removable yet partially and securely received inside the central ring, the stop having a stopping shoulder formed on an outer periphery thereof to abut against a bottom most end of the stop to prevent the plug from escaping from the lid.

4. The lid module as claimed in claim 1, wherein each of the leaves has a rib formed on a side face of each of the leaves, the inner tube has a tapered bottom end face corresponding to the rib such that when the plug is movable relative to the inner tube, engagement between the tapered bottom end face and the ribs forces the leaves to expand outward relative to the tube.

5. The lid module as claimed in claim 4 further comprising a stop removable yet partially and securely received inside the central ring, the stop having a stopping shoulder formed on an outer periphery thereof to abut against a bottom most end of the stop to prevent the plug from escaping from the lid.

6. The lid module as claimed in claim 1, wherein each of the leaves has an annular boss formed on the other side face of each of the leaves to increase engagement with the seal.

7. The lid module as claimed in claim 1, wherein the lid further has a central column having a top portion provided with a first threading formed on an outer periphery thereof to correspond to a first fixing device formed on an inner periphery of the tube and a bottom portion integrally formed with the top portion and having a diameter smaller than that of the top portion, the bottom portion having a second threading formed on an outer periphery thereof, a stop removably received inside the inner ring and having a second fixing device formed on an inner periphery thereof to correspond to the second threading of the central column so that when the second fixing device is connected to the second threading, the stop is securely received inside the inner ring.

8. The lid module as claimed in claim 7 further comprising a seal mounted around an outer periphery of the leaves so that when the leaves are expanded, the seal is expanded to adapt to the inner periphery of the cup body and the plug together with the seal is able to selectively have a water tight engagement with the inner periphery of the cup body.

9. The lid module as claimed in claim 8, wherein each of the leaves has a rib formed on one side face of each of the leaves, the inner tube has a tapered bottom end face corresponding to the rib such that when the plug is movable relative to the inner tube, engagement between the tapered bottom end face and the ribs forces the leaves to expand outward relative to the tube.

10. The lid module as claimed in claim 9, wherein each of the leaves has an annular boss formed on the other side face thereof such that when the seal is mounted around the outer periphery of the leaves, engagement between the seal and the leaves increases.

* * * * *